US010578408B2

(12) United States Patent
Whitworth et al.

(10) Patent No.: US 10,578,408 B2
(45) Date of Patent: Mar. 3, 2020

(54) BALLISTIC BARREL CLEANING SHELL

(71) Applicant: Midwest Outdoor Holdings, LLC, Commerce Township, MI (US)

(72) Inventors: James Curtis Whitworth, Commerce Township, MI (US); John Biafore, Jr., Grand Blanc, MI (US); Patrick Stack, Northville, MI (US)

(73) Assignee: Midwest Outdoor Holdings, LLC, Commerce Township, MI (US)

( * ) Notice: Subject to any disclaimer, the term of this patent is extended or adjusted under 35 U.S.C. 154(b) by 0 days.

(21) Appl. No.: 16/251,810

(22) Filed: Jan. 18, 2019

(65) Prior Publication Data

US 2019/0154414 A1 May 23, 2019

Related U.S. Application Data

(63) Continuation-in-part of application No. 16/226,019, filed on Dec. 19, 2018, which is a continuation-in-part of application No. 15/992,423, filed on May 30, 2018, now Pat. No. 10,302,385, which is a continuation-in-part of application No. 15/340,400, filed on Nov. 1, 2016, now Pat. No. 10,018,455.

(60) Provisional application No. 62/620,142, filed on Jan. 22, 2018.

(51) Int. Cl.

| | |
|---|---|
| ***F42B 8/00*** | (2006.01) |
| ***F42B 5/24*** | (2006.01) |
| ***F42B 7/00*** | (2006.01) |

(52) U.S. Cl.
CPC . *F42B 5/24* (2013.01); *F42B 7/00* (2013.01)

(58) Field of Classification Search
CPC ..... F42B 5/24; F42B 7/08
See application file for complete search history.

(56) References Cited

U.S. PATENT DOCUMENTS

| | | | | | |
|---|---|---|---|---|---|
| 938,836 | A * | 11/1909 | Fessenden | F42B 5/24 | 102/442 |
| 3,097,169 | A * | 7/1963 | Hall | F42B 5/24 | 102/511 |
| 3,102,478 | A * | 9/1963 | Cook | F42B 7/08 | 102/448 |
| 3,208,387 | A * | 9/1965 | Giles | F42B 5/24 | 102/511 |
| 3,470,883 | A * | 10/1969 | Shepherd | A24D 3/08 | 131/332 |
| 3,476,047 | A * | 11/1969 | Davis | F42B 5/24 | 102/442 |
| 5,341,744 | A * | 8/1994 | Shi | F42B 5/24 | 102/430 |

(Continued)

FOREIGN PATENT DOCUMENTS

| | | | | |
|---|---|---|---|---|
| GB | 2343939 A * | 5/2000 | ..... | F42B 7/046 |

*Primary Examiner* — Gabriel J. Klein
(74) *Attorney, Agent, or Firm* — Quinn IP Law

(57) ABSTRACT

A bore cleaning device is configured to clean a bore of a firearm. The device includes a cylindrically shaped cleaning pad including a solid, non-hollow core. The device further includes a propellant providing a force to push the cleaning pad down the bore of the firearm and a payload located in a bore-forward position of the cleaning pad. The device can optionally include a lower charge cap situated between the propellant and the cleaning pad.

5 Claims, 12 Drawing Sheets

(56) References Cited

U.S. PATENT DOCUMENTS

| | | | | |
|---|---|---|---|---|
| 5,777,258 | A * | 7/1998 | Soon | F42B 5/24 102/442 |
| 7,131,381 | B1 * | 11/2006 | Nafziger | F42B 5/24 102/444 |
| 2014/0331886 | A1 * | 11/2014 | Whitworth | F42B 5/24 102/529 |

* cited by examiner

BALLISTIC BARREL CLEANING SHELL

CROSS-REFERENCE TO RELATED APPLICATIONS

This disclosure claims the benefit of U.S. Provisional Patent Application No. 62/620,142 filed on Jan. 22, 2018 and is a continuation-in-part application of U.S. patent application Ser. No. 16/226,019 filed on Dec. 19, 2018 which is a continuation-in-part application of U.S. patent application Ser. No. 15/992,423 filed on May 30, 2018 which is a continuation-in-part of U.S. patent application Ser. No. 15/340,400 filed on Nov. 1, 2016 which issued on Jul. 10, 2018 as U.S. Pat. No. 10,018,455, all of which are hereby incorporated by reference.

TECHNICAL FIELD

This disclosure relates to cleaning devices for use in ballistic barrels, and, more particularly, to a disposable ballistic barrel cleaning shell which clean a bore of a barrel when fired.

BACKGROUND

The statements in this section merely provide background information related to the present disclosure. Accordingly, such statements are not intended to constitute an admission of prior art.

Shotguns and other firearms are well known tools and recreational instruments. Firearm and ballistic barrels require regular cleaning in order to keep the gun in the best condition possible for accurate shooting. One of the main components of a firearm that requires regular cleaning is a bore of the barrel. In fact, the bore should be cleaned after each use; a bothersome and time-consuming task. Because of this, most firearm owners do not clean their shotgun bores at all.

Shoot-through bore cleaning devices are known in the art. Some include rigid frames that connect a lower charge cap to bore-forward cup filled with weight. Some of the compressive force applied to the frame can in some embodiments be transformed into an outwardly oriented radial force that can be used to force intimate contact between cleaning materials and a bore of a barrel. However, some of the compressive force is used to compress the frame and is not directly applied to the cleaning materials.

SUMMARY

A bore cleaning device is configured to clean a bore of a firearm. The device includes a cylindrically shaped cleaning pad including a solid, non-hollow core. The device further includes a propellant providing a force to push the cleaning pad down the bore of the firearm and a payload located in a bore-forward position of the cleaning pad. The device can optionally include a lower charge cap situated between the propellant and the cleaning pad.

BRIEF DESCRIPTION OF THE DRAWINGS

One or more embodiments will now be described, by way of example, with reference to the accompanying drawings, in which:

FIG. 4A shows the components before an exemplary firing event in cross section;

FIG. 4B shows the components immediately after the firing event in cross section;

FIG. 4C shows the components being propelled down the bore in cross section;

DETAILED DESCRIPTION

Figure 1:
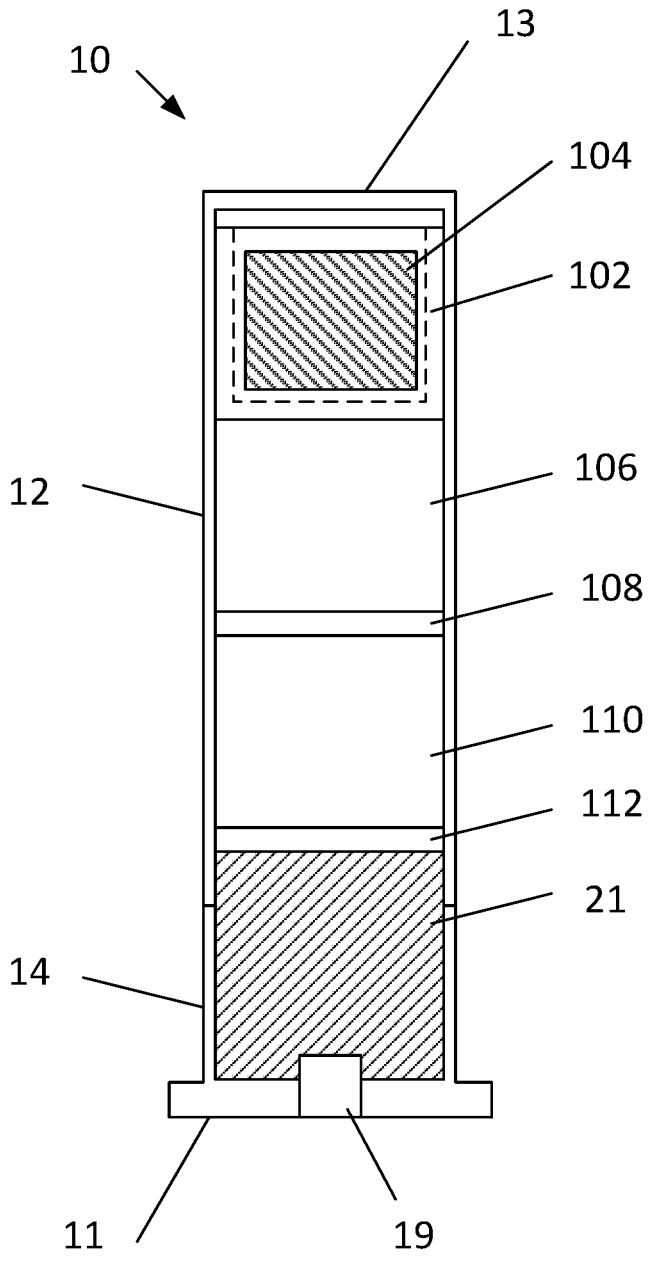
FIG. 1 illustrates an exemplary ballistic barrel cleaning shell in a cross sectional side view, in accordance with the present disclosure.

Reference throughout this specification to "one embodiment," "an embodiment," or similar language means that a particular feature, structure, or characteristic described in connection with the embodiment is included in at least one embodiment of the subject matter of the present disclosure. Appearances of the phrases "in one embodiment," "in an embodiment," and similar language throughout this specification may, but do not necessarily, all refer to the same embodiment.

As used in the description herein and throughout the claims, the following terms take the meanings explicitly associated herein, unless the context clearly dictates otherwise: the meaning of "a," "an," and "the" includes plural reference, the meaning of "in" includes "in" and "on." The term "based upon" is not exclusive and allows for being based on additional factors not described, unless the context clearly dictates otherwise. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

In many ballistic barrels, a shell or casing is loaded directly into a breach portion of a bore of the barrel. Firing rounds leaves residue and debris on the bore surface. This residue and debris may build up through extended and repeated use without appropriate cleaning. When cleaning, a ballistic barrel cleaning shell or bullet can be loaded into the bore. A user may then actuate a trigger on the firearm to fire the ballistic barrel cleaning shell or bullet. The firing of the cleaning shell or bullet allows cleaning material to be moved through the bore in a compressed state, as will be discussed in more detail below.

As opposed to other shoot-through bore cleaning devices utilizing a rigid frame to transmit force from a lower charge cap to a bore-forward cup containing a weight, a cleaning shell is disclosed which imparts a compressive, motive force through a stack of cleaning materials to a bore-forward cup containing a weight. While embodiment utilizing a frame can create an outward radial force by flexing or deforming the frame, some of the compressive force applied to the cleaning materials is used or wasted upon bending the frame. By utilizing a frameless configuration, utilizing a stack of cleaning materials without a frame to transmit force to a bore-forward cup, the disclosed device can maximize compressive force that is used to deform the cleaning materials and create and outward, radial force through the cleaning materials upon the bore.

Figure 2:
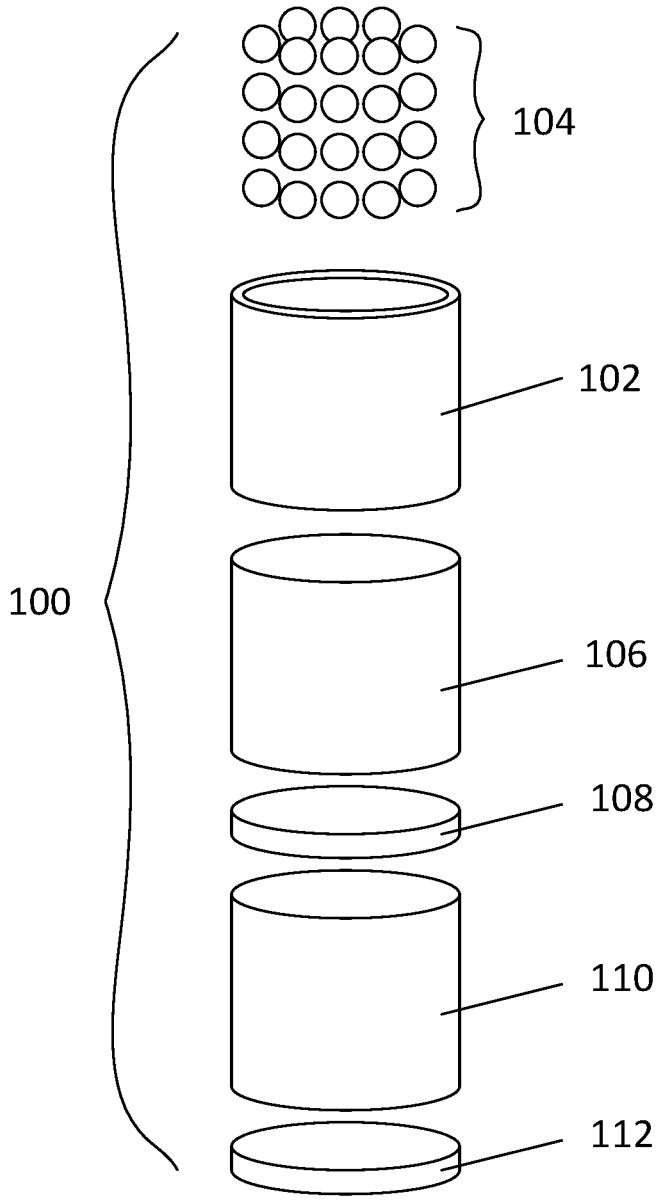
FIG. 2 illustrates cleaning materials of the cleaning shell of FIG. 1 in an exploded perspective view, in accordance with the present disclosure.

Referring now to the drawings, wherein the showings are for the purpose of illustrating certain exemplary embodiments only and not for the purpose of limiting the same, FIGS. 1 and 2 illustrate an exemplary ballistic barrel cleaning shell. FIG. 1 illustrates an exemplary ballistic barrel cleaning shell 10 in a cross sectional side view. FIG. 2 illustrates cleaning materials 100 of cleaning shell 10 in an exploded perspective view. The cleaning shell 10 can be sized to fit different standard gauges of ballistic barrels, such as 10 gauge, 12 gauge, 16 gauge, 20 gauge, 28 gauge, and 410 gauge shotguns, although it is contemplated that the cleaning shell 10 may be sized for smaller gauge firearms such as a handgun. Likewise, the cleaning shell 10 may be sized an adapted for larger ballistic barrels such as artillery barrels.

In this embodiment, the cleaning shell 10 includes a case 12 formed in the shape of a standard gauge shell sized and adapted to hold the cleaning materials 100. In one embodiment, the case 12 is a hollow cylinder with open ends. The case 12 may be formed from any material which can withstand the energy to be applied to it when fired. In one embodiment, the case 12 is formed using a transparent or semi-transparent polymer, in order to allow the user to see what is contained within the case 12.

A first end 11 of the case 12 is preferably attached to a brass end cap 14. In various embodiments, the brass end cap 14 may be formed from any other metallic or non-metallic material which can perform its function while withstanding the force from firing the cleaning shell 10. Brass end cap 14 includes primer 19 configured to provide a spark to propellant 21 within cleaning shell 10 when struck by a firing pin within a firearm. Propellant 21 can include gunpowder or any chemical agent that can explosively expand, thereby providing a propellant force to push cleaning materials 100 down the bore of the firearm. Alternative embodiments could alternatively include springs, compressed air or any other device which could be used to propel the cleaning materials 100 of cleaning shell 10 through the bore of the barrel. In one embodiment, propellant 21 can be augmented or replaced by an oversized primer charge. The opposite end 13 of the case 12 is closed by crimping closed or folding inward sidewall portions of the case 12. Various other closing techniques, as known in the art, may be applied to close the case 12 consistent with the disclosure herein.

In one embodiment, the cleaning materials 100 can include fibrous cup 102, payload 104, first cleaning pad 106, first disc 108, second cleaning pad 110, and second disc 112. Discs 108 and 112 can be constructed of a rubberized material, a polymerized material, or any other material that can act as a wiper as it is propelled down the bore. In another embodiment, one of the discs can act as a gas seal, acting as a barrier between the propellant and the cleaning materials. In one embodiment, disc 112 can be constructed of nylon to act as the gas seal and disc 108 can be constructed of rubber to optimize cleaning ability. Cup 102 and payload 104 included therein are provided for the purpose of providing back pressure to cleaning materials 100 as they are propelled down the bore of the firearm.

Cylindrically shaped cleaning pads and discs can include a solid core, meaning that the items can include a solid, unified cylindrical shape, an integral central portion, or a core without a hollow portion, with such a shape facilitating the cleaning materials evenly transmitting force from the propellant to a bore-forward weight. Further, the solid core of the cylindrically shaped cleaning materials ensures that compression of the cleaning material causes the material to expand radially outward instead of expanding inwardly into a hollow core.

The fibrous cup 102 may be formed of fibrous paper or thin pulp. Preferably, the material is a high temperature resistant material. In the assembled state, the cup 102 is filled with the payload 104. The payload 104 may overflow the cup 102 in various configurations within the case 12.

The payload 104 are preferably dense granular beads. The payload 104 may be formed from one or more exemplary materials including, e.g., lead, zinc, iron, copper. In some embodiments, a metallic or ceramic paste may be used. In one embodiment, the pellets are lead spheres. In one embodiment, the payload 104 are sand granules. Payload 104 start in a resting state within fibrous cup 102. In one embodiment, as propellant 21 forces the materials down the bore, payload 104 resist acceleration and press backwards against a base of fibrous cup 102. This compression or deformation of payload 104 is created by the inertial forces inherent to the dense material when accelerated. This deformation then pushes in a radially outward direction, pressing the fibrous cup 102 against the inner surface of the bore of the barrel. This radially outward force against the cup 102 forces the fibrous material of the cup to create intimate contact with the bore, such that the fibrous material scrubs and loosens debris from the inner surface of the bore.

The first and second cleaning pads 106 and 110, respectively, are, in one embodiment, fibrous cylindrically shaped pads. Cleaning pads 106 and 110 can include solid cores or cores without cavities, such that an entirety of the motive/compressive force applied to the cleaning materials is used to compress the cleaning materials. The cleaning pads 106 and 110 may be formed of one or more of many different material types including e.g., cotton waste, coarse felt material, hard carbon laced polymers, wool, steel or other metallic wool, Scotch Bright® or other suitable material, with or without oil, or an abrasive. In one embodiment, the material is dense, strong, hard material that scrubs the bore and removes glazing, firing powder residue from via application of pressure and rough-edged strands of the material to scrape away residue.

Generally, it is preferable that the material be fairly homogenous so that distortion and compression forces are applied fairly evenly when fired through the barrel and bore. In various embodiments, the material is configured to absorb and hold a bore cleaning fluid. In various embodiments, the material is compressed into a cylindrical shape.

In one embodiment, the first and second cleaning pads 106 and 110 are formed of different materials. In this way, they may serve different cleaning purposes with traversing the bore. For example, the first cleaning pad 106 may function to loosen residue or debris, while the second cleaning pad 110 may function to absorb the residue or debris. In one embodiment, the first cleaning pad 106 is intended as a scrubber-type material, while the second cleaning pad 110 is a collector-type material.

The size of the first and second cleaning pad 106 and 110 may be adapted to a particular barrel and bore size. Preferably, the first and second cleaning pad 106 and 110 is sized to exert enough pressure against the bore surface to clean effectively. In one embodiment, the first and second cleaning pad 106 and 110 are sized about 20% to 40% larger than the outside diameter of the case 12 and be long enough to have sufficient contact with the bore during the firing event. In this way, the first and second cleaning pad 106 and 110 expand when fired and exert a force against the bore's surface.

FIG. 1 illustrates an embodiment useful to clean a bore of a shotgun. It will be appreciated that a similar configuration with minor modifications could be loaded into a casing and useful to clean a bore of a handgun, a rifle, or a larger device such as an artillery cannon.

Figure 3A:
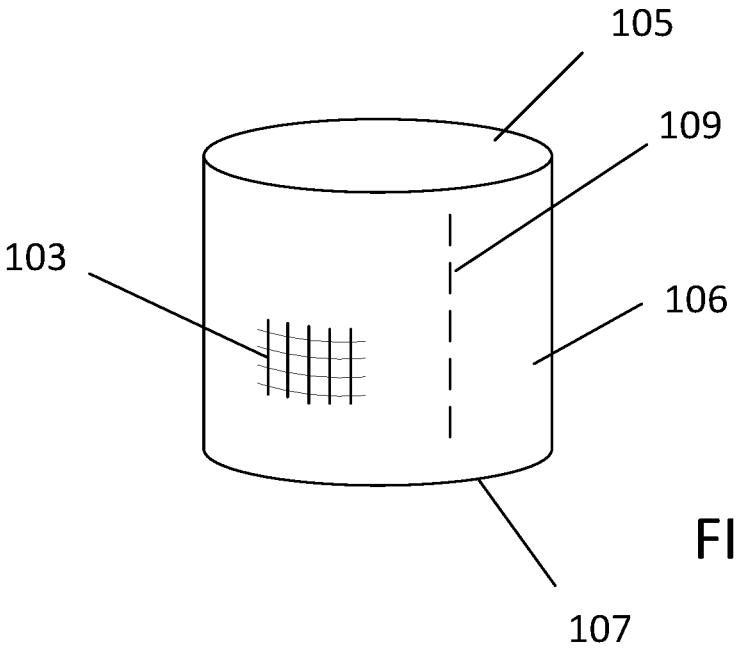
FIG. 3A illustrates in perspective view a cleaning pad of the cleaning shell of FIG. 1 in detail, including exemplary stitch patterns that can be used to create or reinforce the pad material, in accordance with the present disclosure.
Figure 3B:
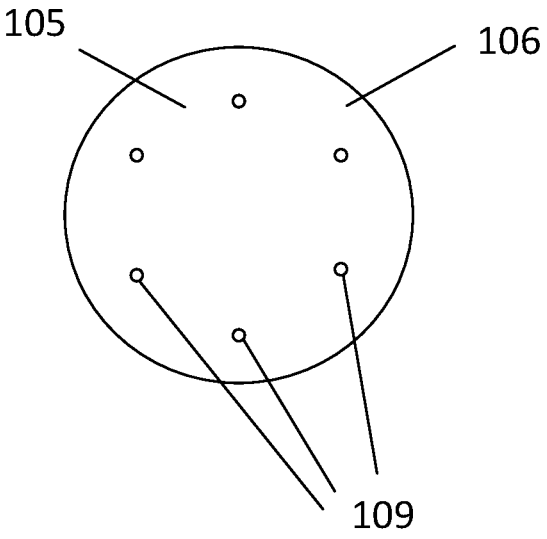
FIG. 3B illustrates in a top view the cleaning pad of FIG. 3A, in accordance with the present disclosure.

In one embodiment, the first and second cleaning pad 106 and 110 is formed of longitudinal stitching 109, traversing from a first end 105 to a second end 107 of the material, such as shown in FIGS. 3A and 3B. Other stitching may thread into various weaving patterns 103 such as illustrated in FIG. 3A. In one embodiment, the stitching forms a felt pad with a generally longitudinal-directed stitching. In one embodiment, the stitching forms a felt pad with a generally longitudinal-directed stitching, but angled slightly, e.g., between 5 and 45 degrees with respect to a longitudinal axis of the pad. Any number of stitching threads may be used. In one embodiment, strand width may vary. In this way, the cleaning pad 106 and 110 expands and distorts symmetrically when fired, it is preferred that the stitching is applied in an even and symmetrical manner with respect to a cross-sectional center. FIG. 3A shows a single stitch 109, as exemplary, to aid in illustrating the longitudinal direction of threading.

FIG. 3B shows a top view of the cleaning pad 106. As FIG. 3B shows, the threads 109 are distributed radially about the center so that a mass of cleaning pad 106 can be symmetrical about the center axis.

Threading illustrated in FIGS. 3A and 3B are illustrative examples. However, pads 106 and 110 can include any configuration of wadded or pressed fibrous materials, for example, in one embodiment including randomly oriented and interwoven fibrous strands forming a pressed into shape pad.

The first and second disc, 108 and 112, respectively, may be formed of one or more of known materials configured to scrape or clean a surface of a bore including, e.g., rubber materials, glass and silica-based substances, composites such as fiberglass, carbon-fiber and/or other like materials, plastic and other polymers such as nylon, any combination thereof, and/or other known and like materials. In one embodiment, the first and second discs 108 and 112 are configured to clean and scrape the bore's surface when fired therethrough. In one embodiment, the first and second discs 108 and 112 are configured to operate to communicate physical forces of the firing state in a symmetrical manner to proximate components. In one embodiment, the first and second discs 108 and 112 are slightly larger than the diameter of the bore, e.g., 1-2%. In one embodiment, the first and second disc 108 and 112 are formed of a semi-rigid material configured for slight compression within the case 12 and expansion within the bore when released during a firing event.

The first and second cleaning pad 106 and 110, and the first and second disc, 108 and 112 may be arranged can have many different configurations consistent with the disclosure herein. For example, the first disc 108 or second disc 112 may be positioned between the payload 104 and the first cleaning pad 106. In one embodiment, a third disc may be used between the payload 104 and the first cleaning pad 106. In one embodiment, only a single disc may be used between the between the payload 104 and the first cleaning pad 106, or between the first and second cleaning pad 106 and 110, or after the second cleaning pad 110.

Figure 4A:
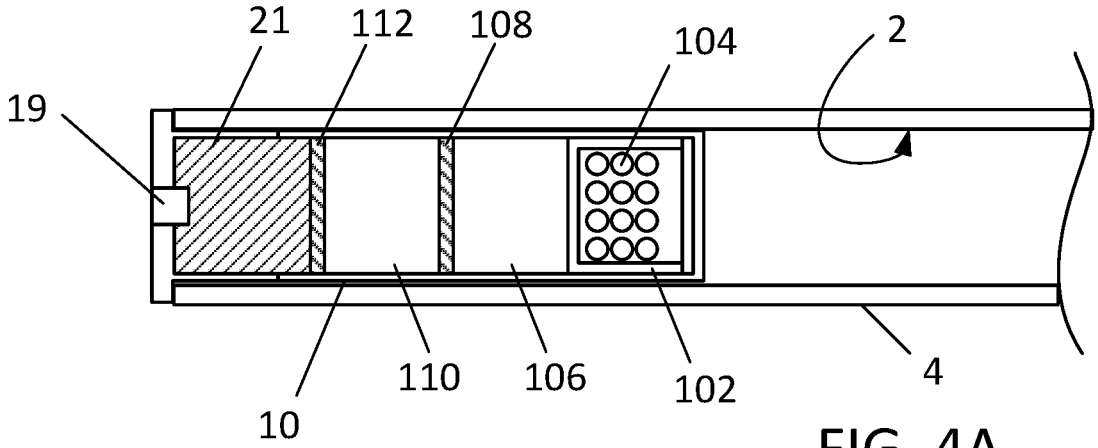
FIGS. 4A-4C illustrate components of the cleaning shell of FIG. 1 within bore or a barrel, in accordance with the present disclosure.
Figure 4B:
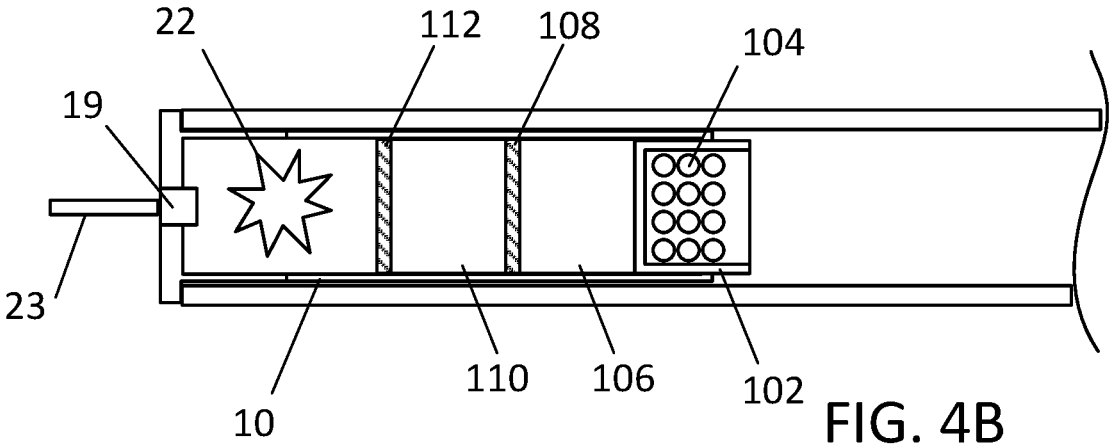
Figure 4C:
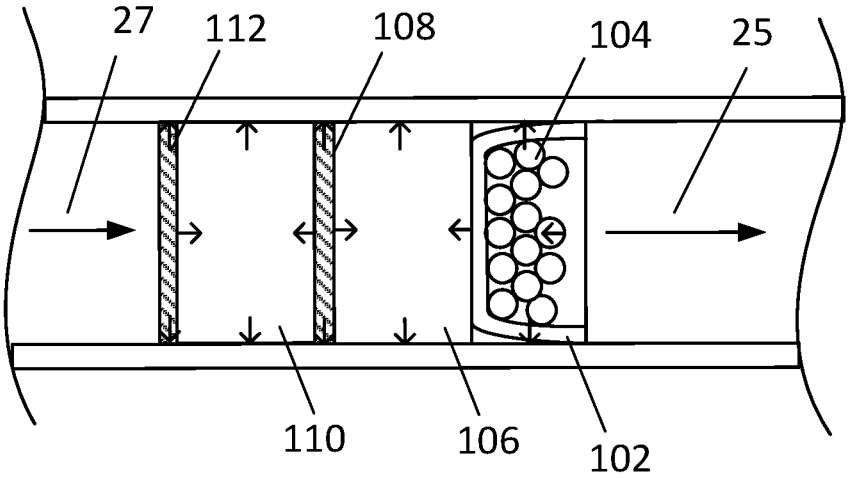

FIGS. 4A, 4B, and 4C illustrate components of the cleaning shell 10 within the barrel bore 2. FIG. 4A shows the components before an exemplary firing event in cross section within a bore of a barrel. Cleaning shell 10 is illustrated loaded within a breach of barrel 4. Cleaning shell 10 fits within bore 2, with cleaning materials including exemplary cleaning pads 106 and 110 and discs 108 and 112 initially fitting within the case of cleaning shell 10. As described herein, pads 106 and 110 and discs 108 and 112 can be compressed prior to being loaded into cleaning shell 10, such that, upon release from cleaning shell 10, each of the cleaning materials can expand outwardly against bore 2. Cleaning shell 10 further includes primer 19, propellant 21, and fibrous cup 102 filled with payload 104. Payload 104 can include pellets, round metallic pieces, BBs, sand, metallic paste, a slug, a bullet, or any weighted object capable of providing back pressure within the bore between the payload and the explosion. This backpressure enables use of a crushing force upon the cleaning materials, enabling compression of the cleaning pad or pads and thereby creating a scrubbing force between the pad and the bore.

FIG. 4B illustrates the components subsequent to the firing event in a cross-section within a bore of a barrel. The firing event is initiated, in one embodiment, by actuating a trigger on a ballistic device. Cleaning shell 10 is illustrated, including primer 19, pads 110 and 106, discs 112 and 108, and fibrous cup 102 filled with payload 104. Firing pin 23 is illustrated striking primer 19, which in turn transforms the propellant of FIG. 4A into explosion 22, which provides a pressure upon disc 112. In one embodiment, a charge cap or lower charge cap can be placed between disc 112 and explosion 22. In another embodiment, disc 112 can be rigid and resilient enough to not be damaged by explosion 22 such that disc 112 can act as a charge cap. Pressure upon disc 112 results in a motive force being applied to all of the cleaning materials, thereby ejecting the cleaning materials and the fibrous cup 102 from cleaning shell 10. One can see pads 106 and 110, discs 108 and 112, and fibrous cup 102 being displaced to a down the bore direction as compared to their initial positions in FIG. 4A. Inertial forces, in particular, inertial forces acting upon payload 104, and friction between the bore and the cleaning materials and along an edge of each of the illustrated components, in combination with the motive force being applied by explosion 22, act to compress the cleaning materials and deform the materials outwardly in a radial direction.

FIG. 4C illustrates in cross section in magnified detail as compared to FIGS. 4A and 4B the cleaning materials and fibrous cup of FIG. 4B moving in a down the bore direction, with compression of the cleaning materials providing deformation and a resulting outward radial scrubbing force in the cleaning materials. FIG. 4C illustrates pads 106 and 110, discs 108 and 112, and fibrous cup 102 some time after the illustrated condition of FIG. 4B, with the illustrated components having moved entirely outside of the case of cleaning shell 10 of FIG. 4B. Arrow 25 illustrates the direction of movement of the illustrated components. Arrow 27 illustrates the motive force still being applied upon disc 112. Discs 108 and 112 are illustrated with arrows pointing outwardly in a radial direction showing the discs expanding radially outwardly, after initially being compressed within the case of cleaning shell 10. Pads 106 and 110 are illustrated with arrows pointing outwardly in a radial direction showing the discs expanding radially outwardly, as a result of both initially being compressed within the case of cleaning shell 10 and as a result of compressive force being applied axially to each of the pads, as is illustrated by arrows pointing inwardly in a direction parallel to the direction of the bore. Fibrous cup 102 is illustrated with arrows pointing outwardly in a radial direction showing the cup deforming outwardly against the bore, with payload 104 being illustrated with an arrow pointing a bore-rearward direction, showing the resulting force causing to press the payload 104 in the bore-rearward direction and deform from their initial state illustrated in FIGS. 4A and 4B. This deformation of payload 104 pushes against the sides of fibrous cup 102 and causes the cup to push outwardly against the bore with a scrubbing force.

Figure 5A:
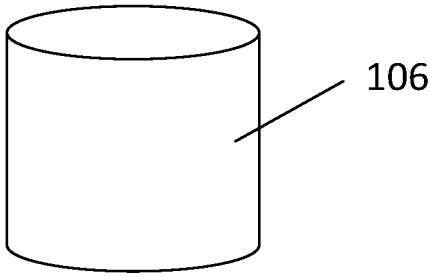
FIGS. 5A and 5B illustrate exemplary distortion and compression forces acting on a cleaning pad of the cleaning shell of FIG. 1, in accordance with the present disclosure.
Figure 5B:
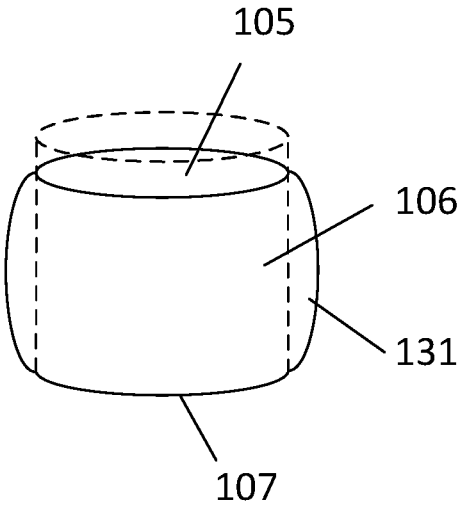

FIGS. 5A and 5B illustrate exemplary distortion of and compression forces acting upon cleaning pad 106. Although cleaning pad 106 is used to illustrate the distortion and compression forces in action, one skilled in the art will readily recognize that similar effects can act upon pad 110 and discs 108 and 112. FIG. 5A shows the cleaning pad 106 in an initial unstressed, uncompressed and stationary state. This is the state that the cleaning pad 106 may take before being placed within the case of the cleaning shell.

FIG. 5B shows the cleaning pad 106 in a state associated with being fired within the bore 2. Dotted lines are used to illustrate the initial unstressed state of FIG. 5A. Solid lines are used to illustrate the effects of pressure or a crushing force acting upon first end 105 and second end 107 of pad 106. Ends 105 and 107 are illustrated being closer to each other than in the initial unstressed state. Side walls 131 are illustrated deforming outwardly, with internal forces within pad 106 causing material to deform outwardly as a result of the forces applied to pad 106.

Figure 6A:
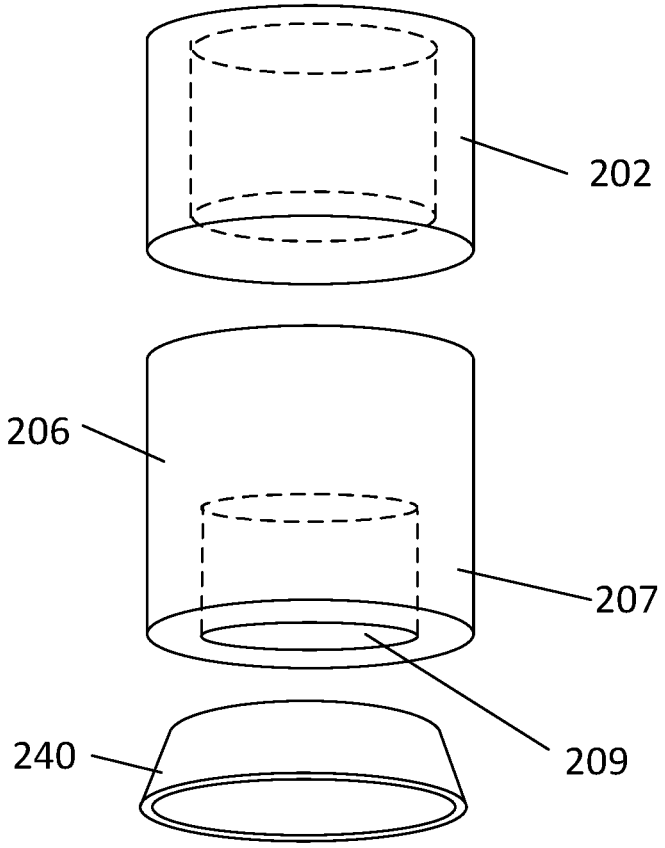
FIG. 6A illustrates in an exploded view an additional exemplary embodiment of cleaning materials that can be utilized within a cleaning shell, in accordance with the present disclosure.

FIG. 6A illustrates in an exploded view an additional exemplary embodiment of cleaning materials that can be utilized within a cleaning shell. Fibrous cup 202, cleaning pad 206, and lower charge cap 240 are illustrated and can be loaded together into a case of a cleaning shell in accordance with other embodiments of the disclosure. Cleaning pad 206 includes cavity 209 which creates thin walls 207 of cleaning pad 206. Motive force being applied to a bottom of pad 206 can easily deform thin walls 207 into an outwardly radial direction, thereby forcing intimate contact between an outside surface of walls 207 and a bore of a barrel. Force can be applied directly to pad 206. In one embodiment, a bottom surface of pad 206 can be sprayed or otherwise treated with a flame retardant material to enable an explosive propellant charge to act directly upon pad 206 without causing the pad to ignite. In another embodiment, a lower charge cap 240 can be used between the propellant and pad 206. Lower charge cap 240 can be situated proximate to and in contact with cavity 209, such that a top surface of charge cap 240 can be forced within cavity 209 by the motive force provided by the propellant.

Figure 6B:
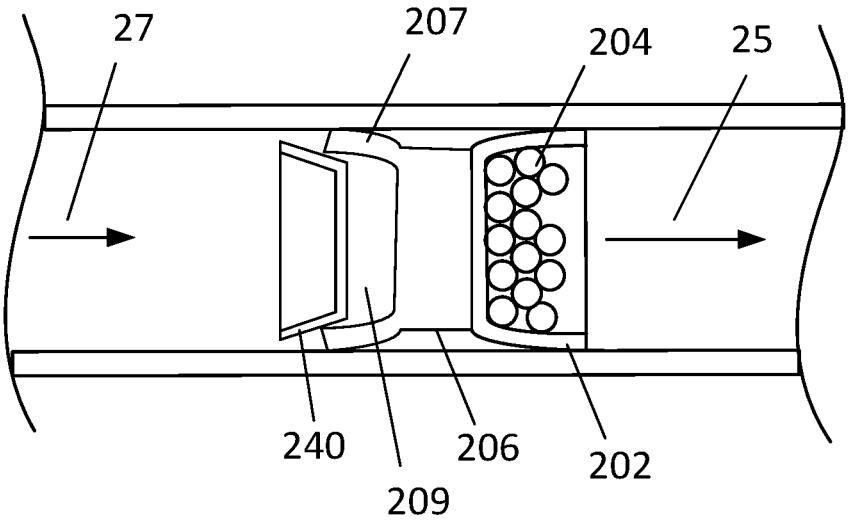
FIG. 6B illustrates in sectional view the cleaning materials of FIG. 6A being propelled down a bore of a barrel, in accordance with the present disclosure.

FIG. 6B illustrates the cleaning materials of FIG. 6A being propelled down a bore of a barrel. Arrow 25 illustrates the direction of movement of the illustrated components. Arrow 27 illustrates the motive force still being applied upon lower charge cap 240. Pad 206 is illustrated with lower charge cap 240 being forced into cavity 209 and with thin walls 207 deforming radially outwardly against the bore.

Fibrous cup 202 is illustrated showing the cup deforming outwardly against the bore, with pellets 204 being illustrated showing a resulting force causing to press the pellets 204 in a bore-rearward direction and deforming from their initial state illustrated in FIG. 6A. This deformation of pellets 204 pushes against the sides of fibrous cup 202 and causes the cup to push outwardly against the bore with a scrubbing force.

Figure 6C:
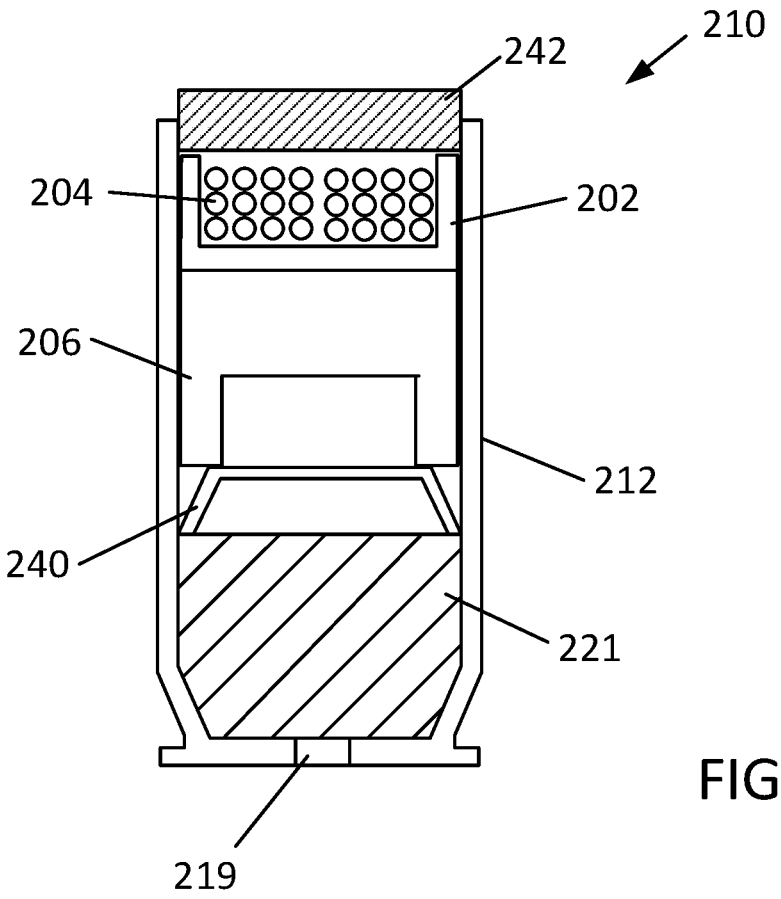
FIG. 6C illustrates the cleaning materials of FIG. 6A loaded into a brass case that can be used within a handgun, in accordance with the present disclosure.

The cleaning materials of FIG. 6A can be used in many different cleaning shell configurations. FIG. 6C illustrates the cleaning materials of FIG. 6A loaded into a brass shell for a handgun. In non-limiting exemplary embodiments, cleaning shell 210 can be configured to fit within a 9 mm chamber, .40 S&W chamber, or a .45 Colt ACP chamber, all of which ammunition types are well known in the art. Fibrous cup 202, cleaning pad 206, and lower charge cap 240 are illustrated within brass case 212. Brass case 212 is illustrated including primer 219 positioned to activate propellant 221. Fibrous cup 202 is filled with exemplary pellets 204. An open end of brass case 212 is sealed with end cap 242. End cap 242 can in exemplary embodiments be made of wax, plastic or polymer material, soft metal material such as lead or copper. End cap 242 can be flat as illustrated or can mock a parabolic outline of a typical bullet for the ammunition being imitated.

FIG. 6C illustrates an embodiment useful to clean a bore of a handgun. It will be appreciated that a similar configuration with minor modifications could be loaded into a case and useful to clean a bore of a shotgun, a rifle, or a larger device such as an artillery cannon.

Figure 7:
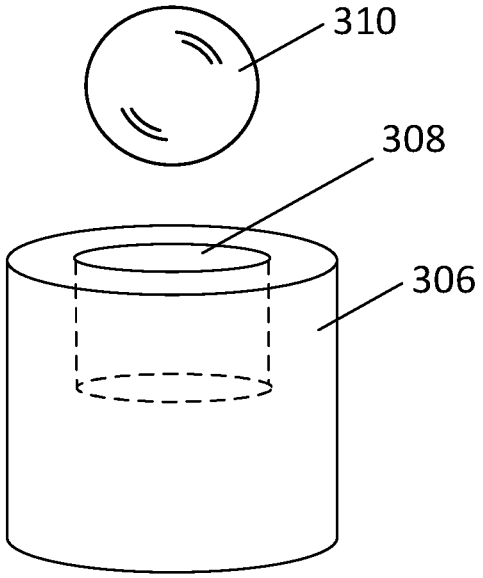
FIG. 7 illustrates an exemplary cleaning pad with a bore-forward cavity, which can be filled with a spherical ball filled with cleaning solution, in accordance with the present disclosure.
Figure 8:
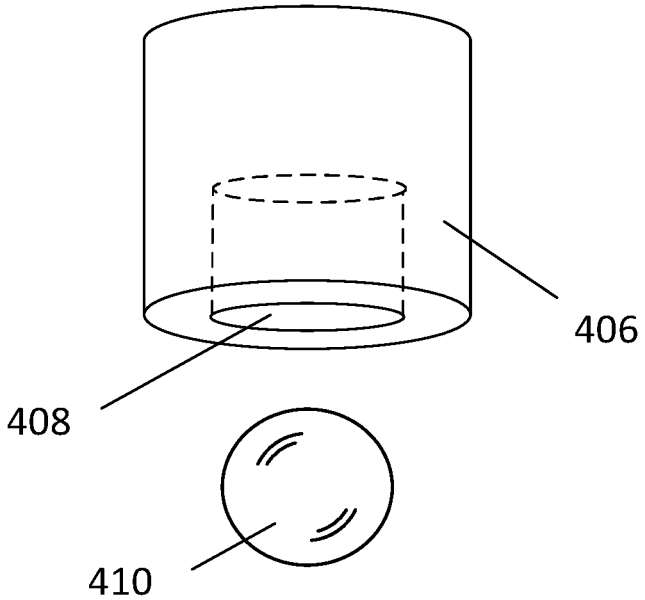
FIG. 8 illustrates an exemplary cleaning pad with a bore-rearward cavity, which can be filled with a spherical ball filled with air or constructed as a solid polymerized ball, in accordance with the present disclosure.

Cleaning pads of different configurations can be utilized. For example, FIG. 7 illustrates an exemplary cleaning pad with a bore-forward cavity, which can be filled with a spherical ball filled with cleaning solution. Ball 310 is situated within cavity 308 of pad 306. Cleaning pad 306 includes a generally solid core through a portion of a length of the pad, retaining an ability to transmit force from an expanding propellant to a bore-forward weight. Ball 310 can be frangible or configured to break easily when a firing event causes compressive forces to act on pad 306, thereby releasing the cleaning solution and saturating pad 306 with the cleaning solution. Similarly, FIG. 8 illustrates an exemplary cleaning pad with a bore-rearward cavity, which can be filled with a spherical ball filled with air or constructed as a solid polymerized ball. As motive force is applied to pad 406, compressive force acting upon ball 410 within cavity 408 can cause the ball to deform into a flattened ball, with the ball becoming wider in a radial direction. This deformation of the ball can aid in deforming the walls of pad 406 proximate to ball 410 in a radially outward direction, such that the walls of pad 406 are forced into intimate contact with the bore of a barrel.

In one embodiment, various oil and fluid may be included in the cleaning shell 10 so that the oil and fluid may be distributed onto the bore's surface as the cleaning shell 10 traverses the bore. For example, the oil or conditioning fluid may be applied to the second cleaning material 110. In one embodiment, cleaning fluid may be applied to the first cleaning pad 106 to loosen and lift residue and debris on the bore's surface.

In one embodiment of the cleaning pad 106 and/or 110 a high density resilient and chemical resistant foam polymer is used. It is compressed along its circumference toward the center axis and placed in the case 12. Upon the firing event, one of the cleaning material components 106 or 110 smoothes out the oil film throughout the bore 6 and, in response to pressure, the applied oil is forced out through capillaries inherent in the cleaning material.

Alternate embodiments of the present invention may be designed for the different gauges or calibers of different firearms. The sizes and shapes of the cleaning materials and discs, and the location of these components in relation to one another within the cleaning shell 10 may be altered in order to adapt to smaller or larger ballistic barrel bores. Therefore, dimensions shown in these drawings and referenced in the specification are only exemplary and are not meant to be limiting.

Figure 9:
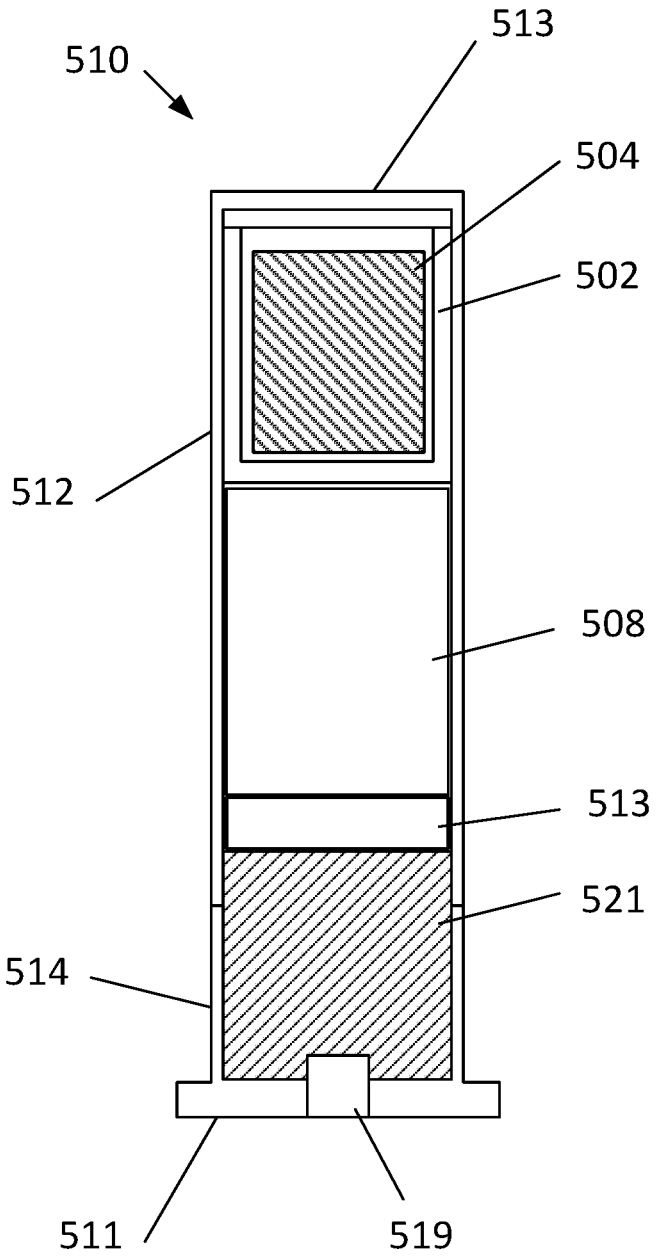
FIG. 9 illustrates an alternative exemplary ballistic barrel cleaning shell in a cross sectional side view, in accordance with the present disclosure.

FIG. 9 illustrates an alternative exemplary ballistic barrel cleaning shell in a cross sectional side view. The cleaning shell 510 can be sized to fit different standard gauges of ballistic barrels, such as 10 gauge, 12 gauge, 16 gauge, 20 gauge, 28 gauge, and 410 gauge shotguns, although it is contemplated that the cleaning shell 510 may be sized for smaller gauge firearms such as a handgun. Likewise, the cleaning shell 510 may be sized an adapted for larger ballistic barrels such as artillery barrels. In this embodiment, the cleaning shell 510 includes a case 512 formed in the shape of a standard gauge or caliber sized and adapted to hold an exemplary cylindrically shaped cleaning pad 508. In one embodiment, the case 512 is a hollow cylinder with open ends. The case 512 may be formed from any material which can withstand the energy to be applied to it when fired. In one embodiment, the case 512 is formed using a transparent or semi-transparent polymer, in order to allow the user to see what is contained within the case 512.

A first end 511 of the case 512 can be attached to a brass end cap 514. In various embodiments, the brass end cap 514 may be formed from any other metallic or non-metallic material which can perform its function while withstanding the force from firing the cleaning shell 510. Brass end cap 514 includes primer 519 configured to provide a spark to propellant 521 within cleaning shell 510 when struck by a firing pin within a selected firearm. Propellant 521 can include gunpowder or any chemical agent that can explosively expand, thereby providing a propellant force to push cleaning pad 508 down the bore of the firearm. A lower charge cap 513 can be located between pad 508 and propellant 521. The opposite end 513 of the case 512 is closed by crimping closed or folding inward sidewall portions of the case 512. Various other closing techniques, as known in the art, may be applied to close the case 512 consistent with the disclosure herein.

FIG. 9 further includes a payload, weight, or mass located in a bore-forward position related to cleaning pad 508. Payload 504 can be provided within cup 502. Cup 502 can be a fibrous material, a plastic or polymer material, or any other material capable of keeping payload 504 in place. As disclosed herein, motive forces applied by expanding propellant 521 squeezes, compresses, or applies a crushing force to cleaning pad 508 against payload 504 as pad 508 and payload 504 are propelled down a bore of a firearm. Payload 504 can include a solid slug, a group of pellets or granular beads, a dense metallic paste, or any other relatively heavy or massive item or groups of items which, as a result of inertia, can provide a bore-rearward force or bore-backward pressure upon pad 508. As a result of being compressed between payload 504 and the motive force, pad 508 is deformed and expands radially outward against a bore of a firearm, thereby causing the pad 508 into making intimate scrubbing contact with the bore.

Figure 10:
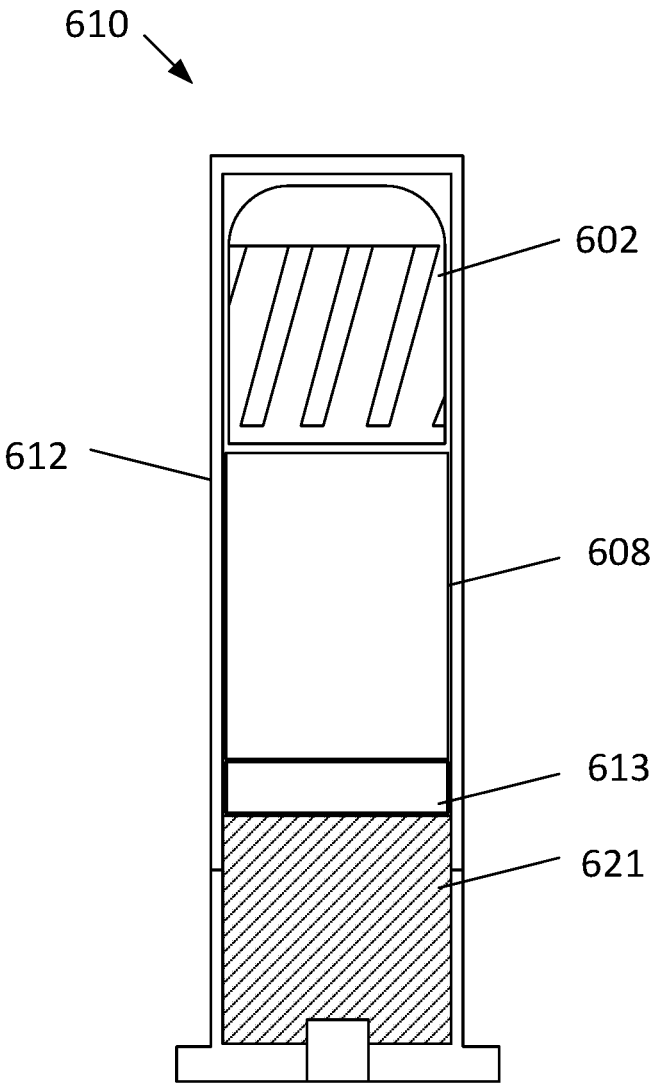
FIG. 10 illustrates an additional exemplary ballistic barrel cleaning shell in a cross sectional side view, wherein a bore-forward weight includes a slug, in accordance with the present disclosure.

FIG. 10 illustrates an additional exemplary ballistic barrel cleaning shell in a cross sectional side view. Cleaning shell 610 of FIG. 10 is similar to the cleaning shell of FIG. 9, with an exception that a bore-forward payload includes rifled slug 602 in place of a cup filled with a weight. Cleaning shell 610 includes slug 602, cylindrically shaped cleaning pad 608, lower charge cap 613, and propellant 621, all initially fitted within case 612. Rifled slug 602 is configured to fit within a firearm barrel including rifling commonly used with deer slug ammunition known in the art. In another embodiment, a slug without rifling can be similarly used for shotgun barrels that do not include rifling.

Figure 11:
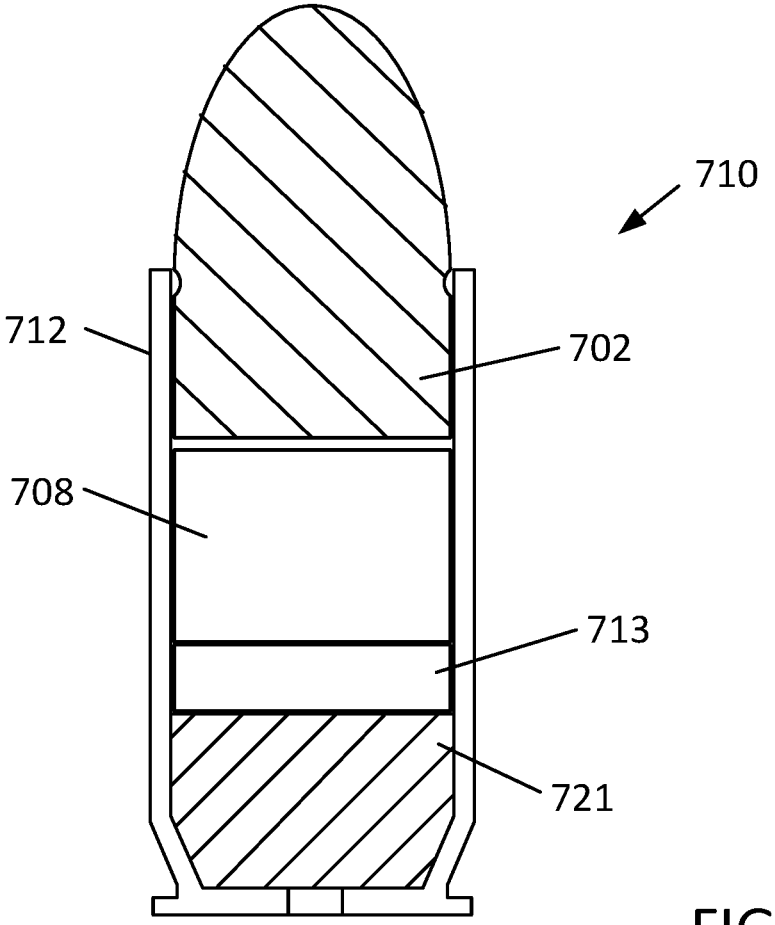
FIG. 11 illustrates an additional exemplary ballistic barrel cleaning shell in a cross sectional side view, the shell comprising a handgun shell and wherein a bore-forward weight includes a bullet, in accordance with the present disclosure.

Space within a shell can be a premium. In particular, within handgun ammunition or within centerfire rifle ammunition, one can be dealing with small fractions of a centimeter in details of a cleaning projectile. Prior art that includes a frame running through a center of a cylindrical pad can result in very thin pads which lack cleaning capacity or in delicate frames that can statistically break and fail to perform their cleaning function. A cylindrical pad with a solid, non-hollow core configured to transfer force from a propellant to a bore-forward weight can be more reliable and utilize a simplified construction to consistently clean the bore, regardless of the small dimensions involved within the shell. In FIG. 11 illustrates an additional exemplary ballistic barrel cleaning shell in a cross sectional side view. Cleaning shell 710 of FIG. 11 is similar to the cleaning shell of FIG. 10, with an exception that a bore-forward weight includes a bullet and case 712 is a brass case typically used in handgun ammunition. It will be appreciated that with small changes, a similar shell configuration can be used in long rifles. Cleaning shell 710 includes bullet 702, cylindrically shaped cleaning pad 708, lower charge cap 713, and propellant 721, all initially fitted within case 712.

Figure 12:
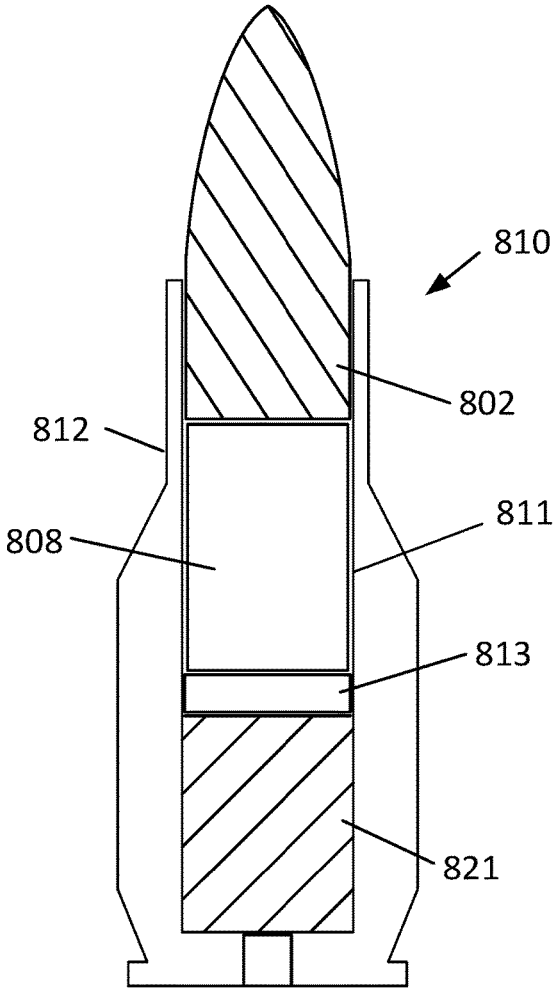
FIG. 12 illustrates an additional exemplary ballistic barrel cleaning shell in a cross sectional side view, wherein the shell comprising a rifle shell and the casing including a cylindrical inner surface, in accordance with the present disclosure.

FIG. 12 illustrates an additional exemplary ballistic barrel cleaning shell in a cross sectional side view. Cleaning shell 810 of FIG. 12 is similar to the cleaning shell of FIG. 11, with an exception that the shell is configured to be operated within a long rifle, chambered for ammunition such as .223, .308, 5.56, or 7.62 caliber rounds known in the art. Cleaning shell 810 includes bullet 802, cylindrically shaped cleaning pad 808, lower charge cap 813, and propellant 821, all initially fitted within case 812. Case 812 includes a cylindrical inner cavity 811 with straight side walls such that the components of shell 810 can be expelled out of shell 810 smoothly.

Figure 13:
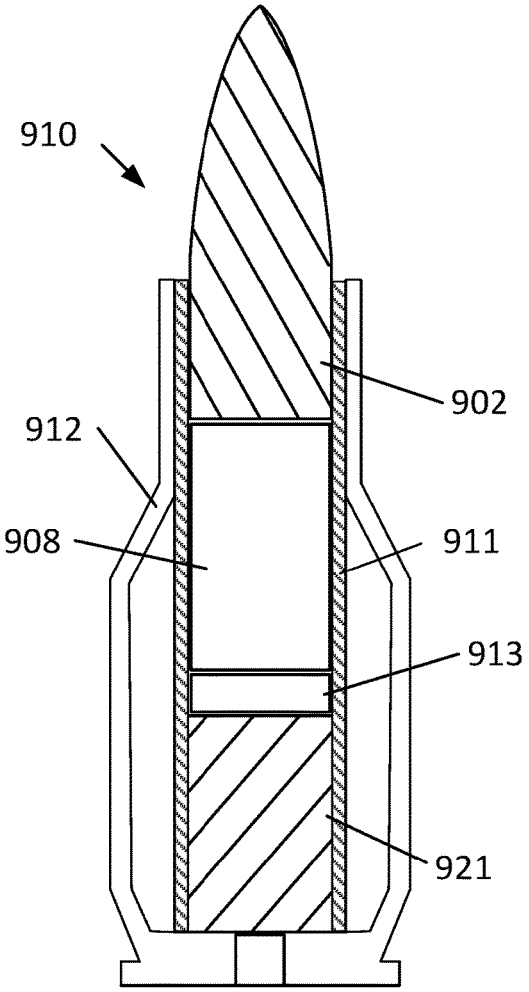
FIG. 13 illustrates an additional exemplary ballistic barrel cleaning shell in a cross sectional side view, wherein the shell comprising a rifle shell and the casing including a cylinder inserted within the casing, with components of the cleaning shell being fit within the cylinder, in accordance with the present disclosure.

FIG. 13 illustrates an additional exemplary ballistic barrel cleaning shell in a cross sectional side view. Cleaning shell 910 of FIG. 13 is similar to the cleaning shell of FIG. 12, with an exception that the shell casing includes a sidewall of substantially constant thickness, with a cylinder inserted within the casing to provide a smooth cylindrical shape for the cleaning shell components to initially set within. Cleaning shell 910 includes bullet 902, cylindrically shaped cleaning pad 908, lower charge cap 913, and propellant 921, all initially fitted within cylinder 911 fitted within case 912. Cylinder 911 includes straight side walls such that the components of shell 910 can be expelled out of shell 910 smoothly.

Pressure or peak pressure achieved by the propellant can vary. Manufacturer specifications and government regulations can dictate maximum peak pressures that are permissible. Selection of the propellant and how much propellant is present in a cleaning shell can control pressures achieved during a cleaning event. A minimum desired pressure can be defined by a requirement to fully burn off the propellant and residue from the primer, so that neither end up as a new contaminant in the bore.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

While the foregoing disclosure discusses illustrative embodiments, it should be noted that various changes and modifications could be made herein without departing from the scope of the described embodiments as defined by the appended claims. Accordingly, the described embodiments are intended to embrace all such alterations, modifications and variations that fall within scope of the appended claims. Furthermore, although elements of the described embodiments may be described or claimed in the singular, the plural is contemplated unless limitation to the singular is explicitly stated. Additionally, all or a portion of any embodiment may be utilized with all or a portion of any other embodiments, unless stated otherwise.

The invention claimed is:

1. An apparatus comprising a bore cleaning device configured to clean a bore of a firearm, the device comprising:

a propellant providing a force to push a projectile down the bore of the firearm;

a bore-forward cup;

a dense material within the cup, wherein the dense material is configured to deform and press radially outwardly against the cup as the propellant provides propelling force to the dense material;

cylindrically shaped cleaning materials between the propellant and the bore-forward cup, the cylindrically shaped cleaning materials comprising at least one fibrous deformable cleaning pad configured to transmit force from the propellant to the bore-forward cup, the deformable cleaning pad comprising a first portion comprising a solid, non-hollow core and a second portion comprising a cavity formed in one end of the deformable cleaning pad; and a charge cap situated between the propellant and the cleaning pad, wherein the cavity is situated proximate to and in contact with the charge cap, and wherein walls of the second portion are operable to deform outwardly against the bore of the firearm when compressed between the bore-forward cup and walls of the charge cap via the force provided by the propellant.

2. The apparatus if claim 1, further comprising a spherical ball situated within the cavity.

3. The apparatus of claim 2, wherein the spherical ball is hollow.

4. The apparatus of claim 2, wherein the spherical ball is filled with a cleaning solution.

5. The apparatus of claim 2, wherein the spherical ball is solid.

* * * * *